US005844178A

United States Patent [19]

Lothringen

[11] Patent Number: 5,844,178

[45] Date of Patent: Dec. 1, 1998

[54] RESONANCE MUFFLER

[76] Inventor: Leopold Habsburg Lothringen, Gschwand 70, A-5342 St. Gilgen-Abersee, Austria

[21] Appl. No.: 817,141

[22] PCT Filed: Oct. 13, 1995

[86] PCT No.: PCT/AT95/00202

§ 371 Date: Apr. 9, 1997

§ 102(e) Date: Apr. 9, 1997

[87] PCT Pub. No.: WO96/14496

PCT Pub. Date: May 17, 1997

[30] Foreign Application Priority Data

Nov. 8, 1994 [AT] Austria ..... 2068/94

[51] Int. Cl.[6] ..... F01N 1/08

[52] U.S. Cl. ..... 181/269; 181/270; 181/280; 181/256; 181/230

[58] Field of Search ..... 181/227, 228, 181/230, 240, 255, 256, 266, 267, 269, 270, 272, 273, 275, 279, 280, 282

[56] References Cited

U.S. PATENT DOCUMENTS

| | | | |
|---|---|---|---|
| 1,505,893 | 8/1924 | Hunter et al. . | |
| 2,173,550 | 9/1939 | Coanda . | |
| 2,494,947 | 1/1950 | Kuttner . | |
| 3,888,331 | 6/1975 | Wang | 181/280 |
| 3,913,703 | 10/1975 | Parker . | |
| 3,941,206 | 3/1976 | Halter . | |
| 4,050,539 | 9/1977 | Kashiwara et al. | 181/280 |
| 4,129,196 | 12/1978 | Everett | 181/280 |
| 4,679,597 | 7/1987 | Stein | 181/280 |
| 4,792,014 | 12/1988 | Shin-Seng | 181/227 |
| 5,109,950 | 5/1992 | Lescher | 181/280 |

FOREIGN PATENT DOCUMENTS

| | | |
|---|---|---|
| 2519690 | 11/1975 | Germany . |
| 3246218 | 6/1984 | Germany . |
| 4020867 | 1/1992 | Germany . |
| 199018 | 10/1938 | Switzerland . |
| 345895 | 4/1931 | United Kingdom . |

*Primary Examiner*—Khanh Dang
*Attorney, Agent, or Firm*—Karl Hormann

[57] ABSTRACT

A resonance muffler for two cycle internal combustion engines, with a rotationally symmetric resonator housing (1) into which an input pipe socket (8) is leading and which itself leads into an output pipe (4) containing a muffler, the resonator housing (1) defining consecutively in the direction of flow a diverging diffusor section (13), an optional intermediate section (14) of constant flow cross-section, as well as a converging reflector section (15), the output pipe (4) extending coaxially through the resonator housing (1) and the input pipe socket (8) leading tangentially into the diffusor section (13).

13 Claims, 3 Drawing Sheets

RESONANCE MUFFLER

BACKGROUND OF THE INVENTION

1. Field of the invention

The invention relates to a resonance muffler for two cycle internal combustion engines with a rotationally symmetric resonator housing having an input pipe socket leading into it and being itself connected to an exhaust pipe including a muffler. Within the resonator housing, there are sequentially arranged, in the direction of flow, a diverging diffusor section, an optional intermediate section, as well as a converging reflector section.

2. The Prior Art

In conventional resonance mufflers, the input pipe socket leads axially into the diffusor section of the resonator housing, resulting in axial flow therethrough, and the exhaust pipe including its muffler is axially connected to the reflector section as a separate component. Because of the diverging and converging sections positioned at opposite ends within the resonator housing, a reverse negative pressure wave is formed for each injected exhaust gas pressure wave, augmenting the clearing or emptying of an internal combustion engine cylinder and resulting, over all, in improved combustion, reduced gas emission, and output efficiency. The terminal muffler is required since the resonator provides no silencing effect.

The structural length of the resonator housing and of the muffler connected thereto is inversely proportional to the number of rotations of an internal combustion engine. For reasons of noise protection, resort is had to lower and lower operative rotations, particularly in connection with small displacement two cycle engines for model airplanes, motor scythes or chain saws. At an operational engine speed of 6,000 rpm a resonance muffler of conventional structure would have an overall length of 1 m, which is unacceptable for the mentioned applications. In those cases, it has hitherto not been possible to make use of the advantages of resonance mufflers, and compact mufflers had to be used which, because they lack any resonance effect, operate uneconomically and pollute the environment. On the one hand, relatively large quantities of combusted gases remain in the cylinder during the exhaust process resulting in inferior combustion, and, on the other hand, relatively large quantities of unburned fuel mixture enter into the exhaust gas. The two effects result in an efficiency reduction of about 35% compared to a resonance muffler.

OBJECT OF THE INVENTION

It is a task of the invention to provide a resonance muffler of highly compact dimensions, so that the advantages of the resonance principle may be applied to small two cycle internal combustion engines, such as motors for airplane models, lawn mowers, chain saws, motor scythes, etc.

SUMMARY OF THE INVENTION

This task is accomplished by a resonance muffler of the kind mentioned in the introduction, which in accordance with the invention is characterized by an exhaust pipe extending coaxially through a resonator housing and an input pipe socket leading tangentially into the diffusor section.

A two-fold saving in space is achieved in this manner. On the one hand, the muffler which is arranged within the output pipe is entirely positioned within the interior of the resonator housing, extending through the resonator housing quasi as a core. On the other hand, the structural length of the resonator is drastically shortened, because owing to their tangential flow approach the exhaust gasses will flow through the resonator housing in a helical flow pattern around the core, so that their effective flow path within the resonator housing is a multiple of the structural length of the resonator housing. The initial enlargement of the cross-section of the flow and the ensuing reduction of the cross-section of the flow required by the described resonator principle, occurs naturally, because the progressive increase in pitch of the helical flow as a result of the initial deflection from the tangential input to the helical flow-through pattern corresponds to a diverging section, and the impinging of the helical flow against the other end of the resonator housing corresponds to a converging section.

For practical purposes, the effectiveness of the diffusor section and/or of the reflector section may respectively be enhanced by a progressive increase and progressive decrease of the diameter of the resonator housing and/or of the reflector section. However, in accordance with a particularly preferred embodiment of the invention, a helical guide wall may alternatively or additionally be arranged between the exhaust pipe and the resonator housing. The pitch of the helical guide wall may, for instance, be kept constant, and the diffusor section and the reflector section are attained solely by the described change in diameter of the resonator housing. It is, however, of particular advantage appropriately to change the pitch of the helical guide wall, and, preferably to form the diffusor section by a progressive or-for purposes of simplifying its manufacture-stepwise increase of the pitch of the helical guide wall. On the basis of the same principle, the reflector section may be formed by the joining of the helical guide wall on a radial end face of the resonator housing.

It should at this point be mentioned that the use of a helical guide wall in a muffler is known per se from U.S. Pat. No. 4,683,978. The guide wall described there is of uniform pitch and is used only to dampen sound rather than to form the diffusor and reflector sections of the resonator housing of a resonance muffler. Moreover, a helical guide wall of variable pitch between an exhaust pipe and an outer housing is known from Swiss patent 199 018, albeit for a completely different purpose, namely for a simple muffler without resonator section, i.e. not for a combination resonance muffler provided with an efficiency-increasing diffusor section, an optional intermediate section, and a reflector section. More particularly, the helical guide wall of the Swiss patent is forming a helical acoustic sound dampening chamber with the exhaust pipe being connected thereto by a plurality of output openings arranged at a variable spacing. In this case, the helical chamber is connected parallel to the exhaust pipe, and the variable pitch serves to form variable elementary sound dampening chambers so that a whole range of sound frequencies may be absorbed or compensated.

In any case, in accordance with a further advantageous embodiment of the invention, the input pipe socket leads into the resonator housing at an acute angle relative its longitudinal axis which makes possible a smooth transition into the helical flow pattern.

A structurally particularly advantageous solution is characterized by the exhaust pipe being connected to the reflector section by radial openings. The end of the exhaust pipe may be affixed in this section to the end wall of the resonator housing, the flow connection being provided by the mentioned radial opening.

To form the muffler within the output pipe, an end pipe is preferably inserted coaxially into the output pipe, and the end pipe extends through the end wall of the resonator housing adjacent to the reflector and terminates at a distance from the end wall of the resonator housing adjacent to the diffusor. In that case it is particularly advantageous in accordance with a further embodiment of the invention to provide a sound dampening coating on the inner surface of the exhaust pipe and on the outer surface of the end pipe.

Furthermore, an emission gas catalytic converter may in any case be provided in the interior of the exhaust pipe without increasing the structural length of the resonance muffler.

Finally, it is particularly advantageous to construct the input pipe socket as a manifold for direct flange mounting on the exhaust opening of a cylinder of an internal combustion engine. In that fashion, replacement of conventional compact mufflers by resonance mufflers may be facilitated.

DESCRIPTION OF THE DRAWINGS

The invention will hereafter be explained in greater detail with reference to embodiments depicted in the drawings. In the drawings

DETAILED DESCRIPTION OF THE PREFERRED EMBODIMENTS

Figure 1:
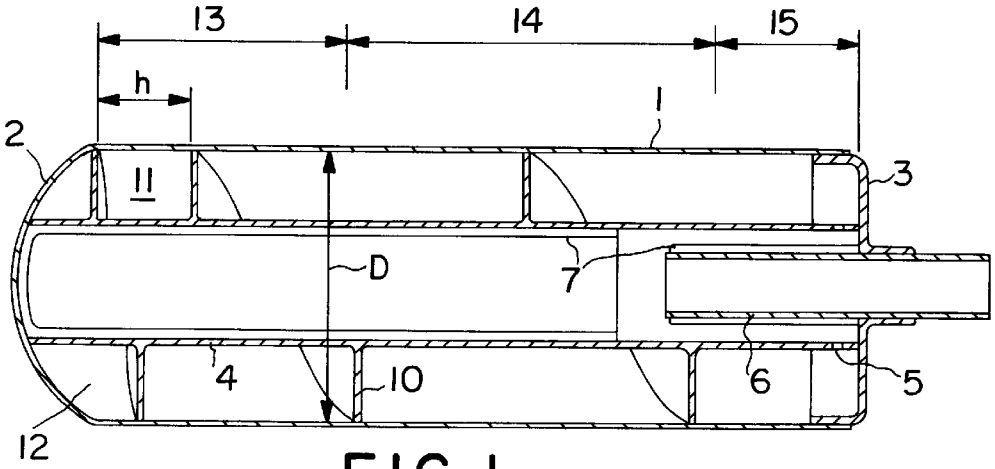
FIG. 1 is a view in longitudinal section of a first embodiment of a resonance muffler in accordance with the invention.
Figure 3:
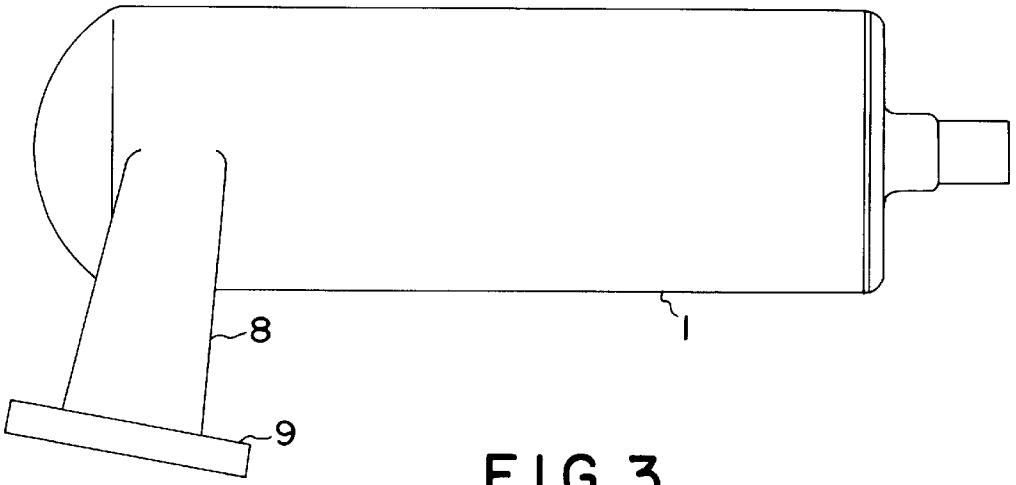
FIG. 3 is a top elevation.
Figure 2:
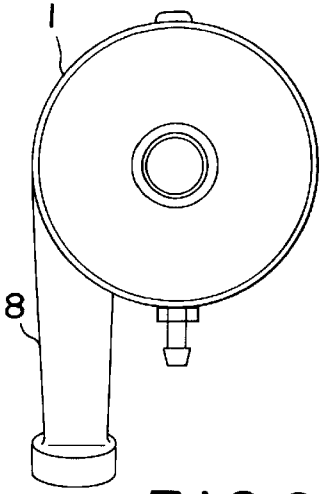
FIG. 2 is a front elevation.

The resonance muffler shown in FIG. 1–3 is provided with a cylindrical resonator housing which at one side is enclosed by a convex end wall 2 and at the other side by a radial end wall 3. In the interior of the resonator housing 1, an exhaust pipe 4 is coaxially extending from the end wall 2 to the end wall 3. Near the end wall 3 the exhaust pipe 4 is provided with radial openings 5. To form a tail pipe, the exhaust pipe 4 may at its opposite end extend directly through the end wall 2; however, to form a muffler in the interior of the exhaust pipe 4 it is preferred—like in the depicted embodiment—to provide for a further flow deflection by coaxially inserting a tail pipe 6 which extends through the end wall 3 to form a tail pipe and which terminates at a distance from the end wall 2. The inner surface of the exhaust pipe 4 and the outer surface of the tail pipe 6 are provided with a sound dampening coating 7.

An input pipe socket 8 leads into the resonator housing 1 adjacent to the end wall 2. At its free end, the input pipe socket 8 is provided with a flange 9 for direct connection to an exhaust opening of a cylinder of a two cycle internal combustion engine (not shown). The input pipe socket 8 leads tangentially (see FIG. 2) and preferably at an acute angle relative to the longitudinal axis of the resonator housing 1 (see FIG. 3), into an annular chamber between resonator housing 1 and exhaust pipe 4. A helical guide wall 10 (FIG. 1) is arranged within this annular chamber and is wound, as seen in the direction of flow from the input pipe socket 8 to the openings 5 of the exhaust pipe 4, around the exhaust pipe 8 in a counter clockwise direction. The input pipe socket enters directly into the first convolution 11. An unused dead space 12 is provided between the convolution 11 and the end wall 2. At its end facing the openings 5 of the exhaust pipe 4 the guide wall 10 engages the end wall 3 at an angle.

In a first axial section 13, the pitch h of the helical guide wall 10 increases progressively in a direction away from the input pipe socket 8, in a second axial section 14 it remains constant, and in a third axial section 15 it diminishes naturally by engaging the end wall 3. In this manner, the effective cross-section of the flow is continuously widened in section 13; it stays constant in section 14, and it is diminished again in section 15. Hence, sections 13–15 correspond to the diffusor section, the intermediate section and the reflector section of conventional resonance mufflers with axial flow-through patterns, but since they are helically wound around the exhaust pipe they require significantly less mounting space.

Figure 4:
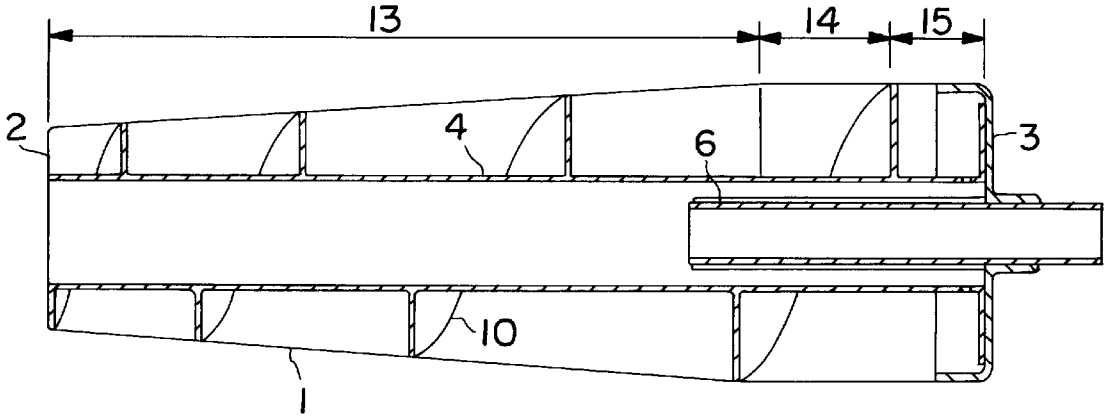
FIG. 4–6 are views in longitudinal section of three further embodiments of resonance mufflers in accordance with the invention.

Alternatively, the section 14 may be dispensed with, and/or the pitch h may be gradually reduced in section 15 before its engagement with the end wall. By way of augmentation, the outer diameter D of the resonator housing may in addition be progressively increased at section 13, as shown in FIG. 4, and/or it may be progressively reduced. Generally speaking, one may resort to two parameters for affecting the flow diameter in sections 13, 14, and 15, i.e., the pitch h and the diameter D.

As a further alternative, a stepped increase of the pitch h in section 13 may be provided instead of the progressive increase of the pitch h, which would simplify manufacture. In the simplest case, the diffusor section is formed simply by the transition from a first (short) section having a uniform small pitch $h_1$ to a second section having a large pitch $h_2$ (not shown), which means that the diffusor section is formed in the passage of a helical convolution in the area of the transition step. The first (short) section ahead of the stepped transition (the diffusor section) may in such a case be considered as a simple extension of the tangentially connected input pipe socket and it may thus be considered to be a part of it.

Figure 6:
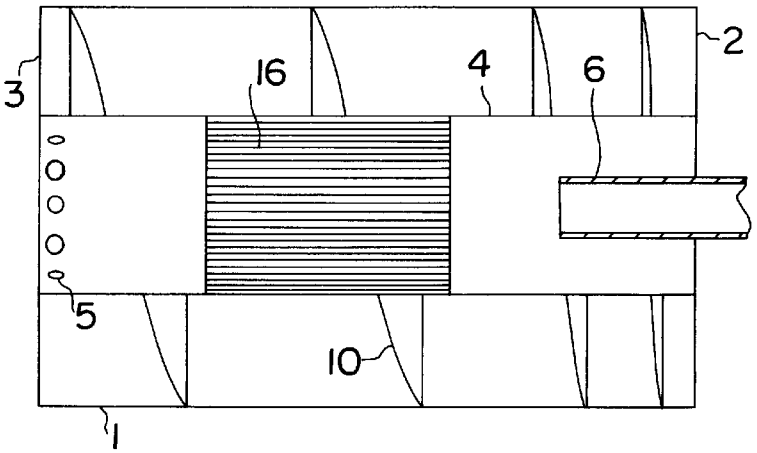
Figure 5:
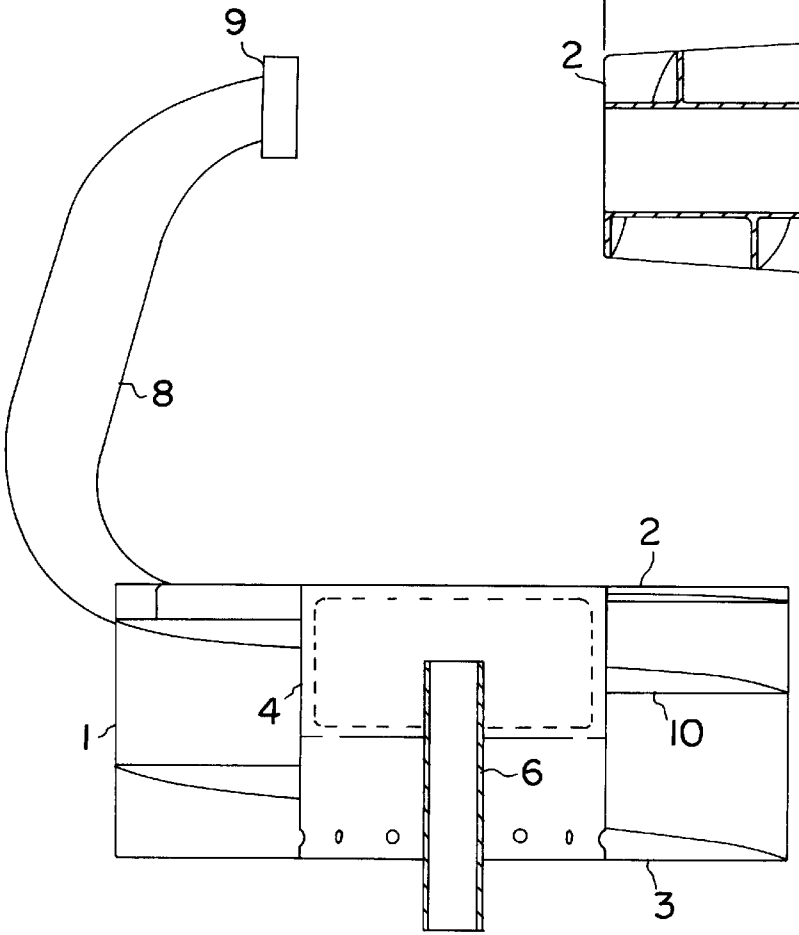

FIG. 5 depicts an embodiment for vertical mounting, e.g. below the motor of a motor scythe, and is of short structural length and large outer diameter. In the embodiment of FIG. 6, in which the flow through the annular chamber between the exhaust pipe 4 and the resonator housing 1 is directed from right to left, the double deflection in the interior of the exhaust pipe 4 has been dispensed with so that space is created for mounting a conventional catalytic converter 16 within the exhaust pipe 4 between the openings 5 and the tail pipe 6

Figure 8:
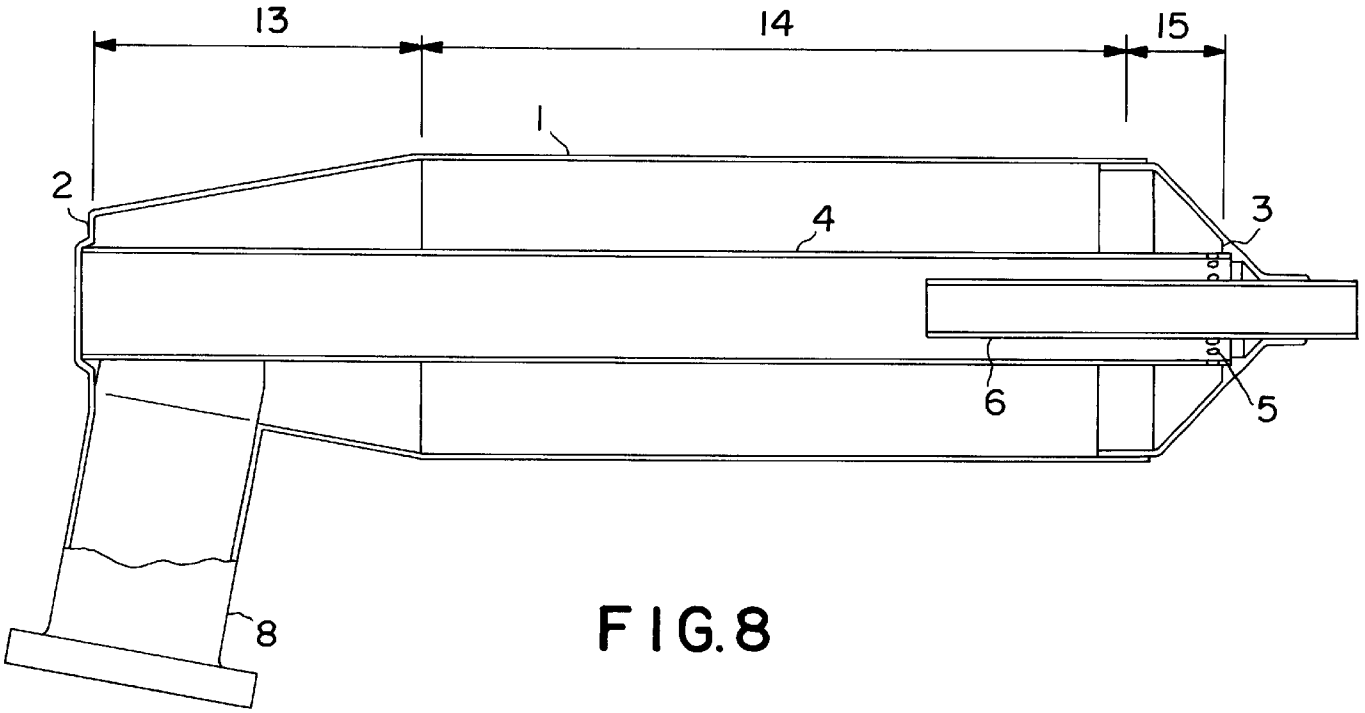
FIG. 7 and 8 respectively show a front elevation and a view in longitudinal section of a further alternative embodiment of the resonance muffler in accordance with the invention.
Figure 7:
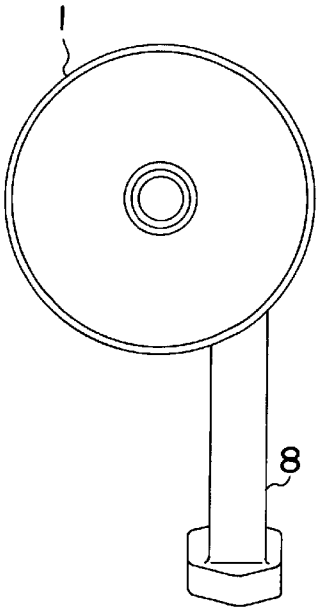

In FIG. 7 and 8 there is depicted an alternative embodiment especially for high revolution engines, in which there is no need for providing a guide wall 10, yet its principle of operation remains the same. Because of the tangential arrangement of the input socket 8 and the coaxial arrangement of the exhaust pipe 4 extending through the resonator housing 1, a helical flow of exhaust gases around the exhaust pipe 4 in the direction of the openings 5 will result naturally. The increase in the flow cross-section in section 13 and its reduction in section 15 are enhanced by a corresponding increase and decrease of the external diameter D of the resonator housing. It is to be noted, however, that such a measure is enhancing but not compulsory, because the gradual deflection of the essentially circular flow at the input area of the input socket 8 into an essentially helical flow in the intermediate section 14 will result naturally in an enlargement of the effective flow cross-section in section 13 and, vice versa, in a corresponding reduction in the area where the helical flow encounters the end wall 3. Where there is no reduction of the external diameter, the resonance effect will still amount to about 65%, compared to a resonance effect of 100% in an optimal structure.

The embodiment without any guide wall 10 is primarily suitable for two cycle engines operating at 15,000 to 30,000 rpm, whereas an embodiment with a guide wall is to be preferred for lower numbers of rotations.

With the proposed structure, the structural length of a resonance muffler may for a given operational rotation by reduced to at least ⅓ to about 1/10 of the length of conventional resonance mufflers with axial flow.

What is claim is:

1. An exhaust gas resonance muffler for an internal combustion engine, comprising:

housing means for forming a resonance chamber having an internal wall configured substantially rotationally symmetric around a predetermined axis and enclosed by forward and rearward closure means;

means for forming a diverging diffusor in a first section of the resonance chamber adjacent to one of the forward and rearward closure means;

means for forming a converging reflector in a second section of the resonance chamber adjacent to the other of the forward and rearward closure means;

means for forming an exhaust gas output member extending through the chamber substantially coaxially therewith and opening through the other closure means;

means for forming an exhaust gas input member entering substantially tangentially into the first section of the chamber.

2. The muffler of claim 1, wherein the means for forming a diverging diffusor comprises a web member helically wound around the output member in the chamber between the forward and rearward closure means.

3. The muffler of claim 2, wherein the diverging diffusor is formed by the web being wound around the output member as a helix of continuously increasing pitch in the direction of the other closure means.

4. The muffler of claim 2, wherein the diverging diffusor is formed by the web being wound around the output member as a helix of a pitch increasing in steps in the direction of the other closure means.

5. The muffler of claim 1, wherein the means for forming a diverging diffusor comprises at least a section of the internal wall member conically flaring out from the one closure means in the direction of the other closure means.

6. The muffler of claim 1, wherein the means for forming a converging reflector comprises the web engaging the other closure means.

7. The muffler of claim 1, wherein the means for forming a converging reflector comprises at least a section of the internal wall member conically flaring out from the other closure member in the direction of the one closure member.

8. The muffler of claim 1, wherein the exhaust gas input member comprises pipe means leading into the resonance chamber at an acute angle.

9. The muffler of claim 1, wherein the exhaust gas output member comprises an elongate pipe member.

10. The muffler of claim 1 wherein the exhaust gas output member is provided with radial openings leading into the second section.

11. The muffler of claims 9, wherein a tubular member penetrating through the other closure means and terminating at a predetermined distance from the one closure means is coaxially disposed within the elongate pipe member.

12. The muffler of claim 11, wherein the inner surface of the elongate pipe member and the outer surface of the tubular member are provided with a sound dampening coating.

13. The muffler of claim 1, wherein an exhaust gas input member comprises manifold means adapted for a direct flanged connection to an exhaust gas opening of a combustion cylinder of the internal combustion engine.

* * * * *